US005387500A

United States Patent [19]

Ling et al.

[11] Patent Number: 5,387,500

[45] Date of Patent: Feb. 7, 1995

[54] COLOR PHOTOGRAPHIC ELEMENTS CONTAINING A COMBINATION OF PYRAZOLOAZOLE COUPLERS

[75] Inventors: Hans G. Ling, Rochester; Drake M. Michno, Webster, both of N.Y.

[73] Assignee: Eastman Kodak Company, Rochester, N.Y.

[21] Appl. No.: 250,353

[22] Filed: May 27, 1994

Related U.S. Application Data

[63] Continuation of Ser. No. 82,073, Jun. 24, 1993, abandoned.

[51] Int. Cl.[6] ..... G03C 1/46

[52] U.S. Cl. ..... 430/506; 430/503; 430/558; 430/387

[58] Field of Search ..... 430/503, 506, 558, 387

[56] References Cited

U.S. PATENT DOCUMENTS

| | | | |
|---|---|---|---|
| 4,390,618 | 6/1983 | Kobayashi et al. | 430/558 |
| 4,734,357 | 3/1988 | Mihayashi et al. | 430/558 |
| 4,777,122 | 10/1988 | Beltramini et al. | 430/506 |
| 4,900,655 | 2/1990 | Nakazyo et al. | 430/558 |
| 4,963,465 | 10/1990 | Matejec et al. | 430/506 |
| 5,021,325 | 6/1991 | Burns et al. | 430/558 |
| 5,066,575 | 11/1991 | Sato et al. | 430/558 |
| 5,183,728 | 2/1993 | Romanet et al. | 430/558 |

FOREIGN PATENT DOCUMENTS

| | | |
|---|---|---|
| 0217353 | 4/1987 | European Pat. Off. . |
| 0384487 | 8/1989 | European Pat. Off. . |
| 62-206544 | 9/1987 | Japan . |

OTHER PUBLICATIONS

Toshibumi et al. Abstract JP 61-72238, "Silver Halide Color Photosensitive Material", (1986).

Abstract JP 2-89053, Fuji Photo Film KK. (1988).

*Primary Examiner*—Charles L. Bowers, Jr.

*Assistant Examiner*—Geraldine Letscher

*Attorney, Agent, or Firm*—Arthur E. Kluegel

[57] ABSTRACT

A photographic element including a support and at least two green-sensitive silver halide emulsion layers of different sensitivity, each emulsion layer including a two-equivalent pyrazoloazole magenta dye-forming coupler having a structure according to formula I of the disclosure. The activity of the dye-forming coupler present in the layer of lower sensitivity is less than the activity of the dye-forming coupler present in the layer of higher sensitivity.

20 Claims, No Drawings

COLOR PHOTOGRAPHIC ELEMENTS CONTAINING A COMBINATION OF PYRAZOLOAZOLE COUPLERS

This application is a continuation of application Ser. No. 08/082,073, filed Jun. 24, 1993, abandoned.

BACKGROUND OF THE INVENTION

1. Field of the Invention

This invention relates to silver halide photographic materials having improved granularity and color saturation. In particular, the invention relates to a photographic element containing at least two separate layers of different sensitivity to green light, including a more active pyrazoloazole magenta coupler in the more sensitive layer and a less active pyrazoloazole magenta coupler in the less sensitive layer or layers.

2. Description of Related Art

There is a continuing need in the photographic art to improve and optimize the attributes of the film, such as the image structure of the film. In particular, there is a desire to reduce the amount of "noise," or nonuniformity, in the developed film. The visual sensation produced by such nonuniformity is termed "graininess," while the objective measure of the nonuniformity is termed "granularity." See T. H. James, "The Theory of the Photographic Process," (4th ed 1977), pp. 618–33). Preferably, reduction in the granularity of the developed film should be achieved without adversely affecting other photographic parameters, such as sensitivity to light (speed), latitude, sharpness, interimage effects, curve shape, D-max, and density.

Various approaches to optimizing granularity are known in the art. Such approaches include: coating high concentrations of silver; reducing the size of grains in the film; and decreasing the full development of grains by the use of development inhibitors. The foregoing methods are not always desirable, however, since they require the coating of additional silver in order to obtain the desired curve shape and density. The use of more silver is additionally disadvantageous since it often results in increased light scattering, which degrades the performance of the underlying layers. Moreover, use of excess silver can result in difficulties in the removal (bleaching) of the silver from the developed film.

Smearing couplers have also been used to reduce granularity. This method, however, often undesirably reduces the film sharpness.

Another approach, use of couplers that generate low extinction dyes, involves the use of more silver, with the accompanying disadvantages discussed above.

Another method, involving coating reduced amounts of couplers in the layers of the photographic element in order to "starve" the coupler, generally has a negative impact on D-max, curve shape, color saturation, and silver efficiency.

All of the known methods of reducing granularity typically have an adverse effect on other film properties. Accordingly, there is a need for a film that has reduced granularity and the desired high color saturation without adverse impact on other desired photographic parameters such as latitude, sharpness, inner image effects, and total materials laydown for silver, couplers, and other components.

SUMMARY OF THE INVENTION

These and other needs have been satisfied by providing, in accordance with one aspect of the invention, a photographic element comprising a support and at least two green-sensitive silver halide emulsion layers of different sensitivity. Each green-sensitive silver halide emulsion comprises a two-equivalent pyrazoloazole magenta dye-forming coupler having a structure according to formula I:

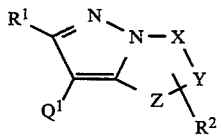

(I)

wherein $R^1$ is a substituent in the 6-position which does not adversely affect the desired properties of the coupler, $Q^1$ is a coupling-off group, X, Y, Z are individually carbon or nitrogen atoms necessary to complete an azole ring, with unsaturated bonding being present in the ring as needed, $R^2$ denotes the group

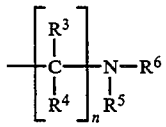

$R^3$, $R^4$ are individually hydrogen or unsubstituted or substituted alkyl or aryl, at most one of $R^3$ and $R^4$ being hydrogen, n is 1 or 2, $R^5$, $R^6$ are individually hydrogen, unsubstituted or substituted alkyl or aryl, —C(O)—$R^7$ or —$SO_2R^7$, at most one of $R^5$ and $R^6$ being hydrogen, $R^7$ is unsubstituted or substituted alkyl or aryl or —NH—$R^8$, and $R^8$ is unsubstituted or substituted alkyl or aryl.

Preferably, the pyrazoloazole coupler according to formula I is a pyrazolotriazole coupler.

The activity of the magenta coupler present in the layer of lower sensitivity is less than the activity of the magenta coupler present in the layer of higher sensitivity. Preferably, the activity of the former magenta coupler is less than about 85% of the activity of the latter magenta coupler.

The photographic element can optionally include at least one additional silver halide layer sensitive to green light, of a sensitivity intermediate between the higher and lower sensitivity layers. The intermediate and lower sensitivity layers include the same magenta coupler.

It is not necessary that these layers of different sensitivities to green light be contiguous, but they may be separated in space by other layers, such as nonimaging interlayers or layers sensitive to other wavelengths of light, such as blue or red light.

There are also provided multi-color photographic elements including a magenta dye image-forming unit as described above, and processes for developing images in photographic elements including such image-forming units.

DETAILED DESCRIPTION OF THE PREFERRED EMBODIMENTS

It has now been discovered that incorporation according to the invention of a higher-activity two-equivalent pyrazoloazole magenta coupler in a more sensitive layer of a magenta image-forming unit, and a lower-activity two-equivalent pyrazoloazole coupler in a less sensitive layer of the same magenta image-forming unit, results in a marked improvement in both graininess (having low granularity) and color saturation (having high color saturation), without adversely affecting other film characteristics.

The term "activity" as used herein denotes the rate at which a coupler reacts with oxidized developer. A coupler of higher activity will react with oxidized developer to form dye more rapidly than a coupler of lower activity. When the coupler of higher activity is much more active than the coupler of lower activity (for example, one thousand times as active), the more active coupler will react with the oxidized developer until the coupler is substantially depleted. Substantially none of the less active coupler will react until depletion of the more active coupler. In contrast, when the coupler of higher activity is only somewhat more active than the coupler of lower activity (for example, twice as active), the more active coupler will react somewhat in preference to the less active coupler, but both will react to some extent depending on the amount of development. Thus, at low exposures (with low amounts of oxidized developer generated), reaction of the more active coupler will dominate, with the less active coupler reacting to a slight extent. At mid-level exposures, both couplers will react, with the more active coupler reacting to a slightly greater extent than the less active coupler. At high exposures, the less active coupler will react to a slightly greater extent than the more active coupler.

According to the invention, the activity of the coupler in the less sensitive layer preferably is less than about 85% of the activity of the coupler in the more sensitive layer.

It is preferred that the higher activity magenta coupler is coated in the faster silver halide emulsion in such a way that some coupler starvation (as described, for example, in U.S. Pat. Nos. 3,843,369 and 4,145,219 and U.K. Patent No. 923,045) will occur in this fast layer. The coupler is matched with the emulsion in a way such that the optimum photographic speed, latitude and density is obtained in this layer. This means that the coupler typically reacts with oxidized developer as soon as it is generated until the coupler is depleted. The activity of this coupler is high enough to allow the coupling reaction to compete with other image-modifying chemistries in the layer, such as the action of DIR compounds, so as to optimize the desired speed. It is preferred that the ratio of coupler to silver halide emulsion, on the basis of coated weight, be less than about 0.20.

The lower activity coupler is coated in the slower emulsion in such a way as to optimize granularity. The slower emulsion and coupler are chosen to give the optimum latitude and curve shape for effective imaging together with the fast layer. These optimizations are carried out in a manner known to those skilled in the art.

The activity of couplers can be measured by comparing the relative rates of activity. A test has been established which uses citrazinic acid (CZA) (2,6-dihydroxyisonicotinic acid) to compete with the coupler. High activity couplers will generate more dye than low activity couplers in competition with CZA. The method of determining relative coupler activities is described in Example 1 below.

Pyrazoloazole couplers useful according to the instant invention are not designated as intrinsically "fast" or "slow", that is, more active or less active. Rather, each coupler can be "fast" or "slow" relative to the other coupler with which it is employed. That is, a coupler may be "fast" with respect to one particular pyrazoloazole coupler, but "slow" with respect to another pyrazoloazole coupler, although both fall within formula I. In particular, a coupler A can have an activity less than about 85% of a coupler B, but a coupler C in turn can have an activity less than about 85% of that of coupler A.

The pyrazoloazole couplers according to formula I preferably are substituted at the 6-position by a group $R^1$ which is unsubstituted or substituted alkyl, aryl, alkoxy or carbonamido.

Preferred examples of the group $R^2$ include:

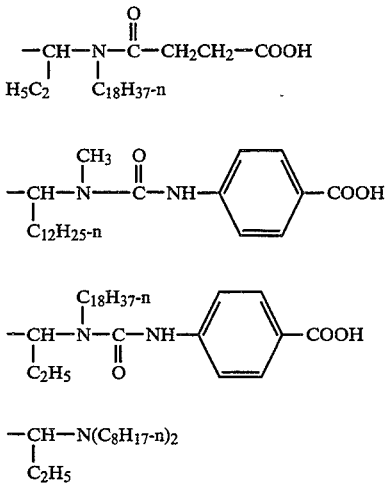

-continued
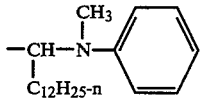
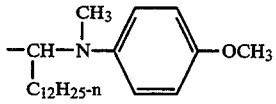
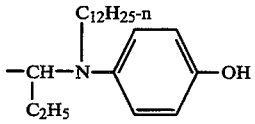
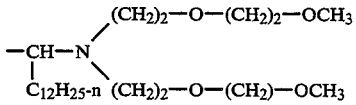
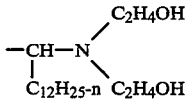
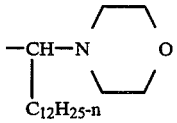
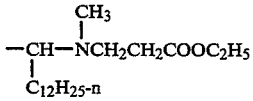
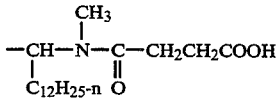
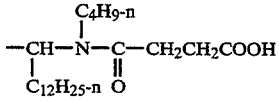
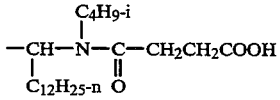
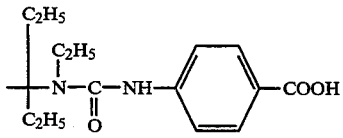
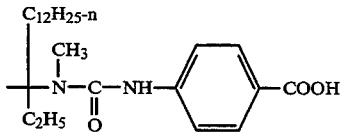
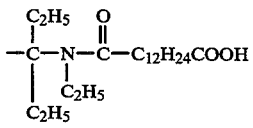

-continued
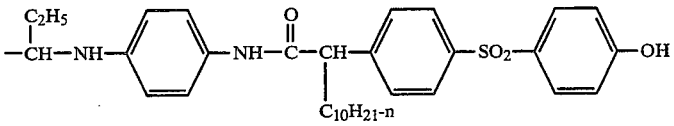
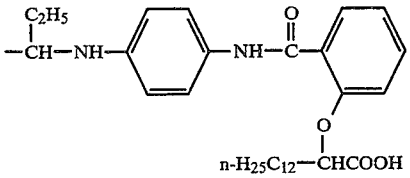
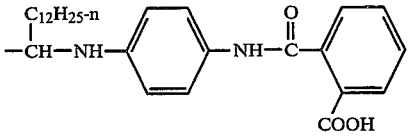
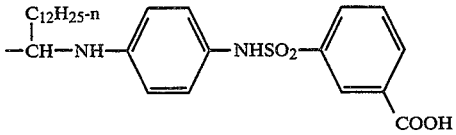
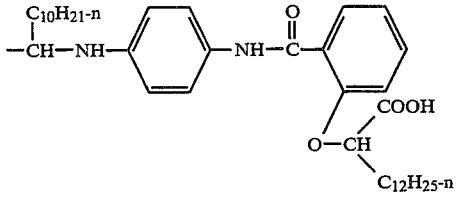
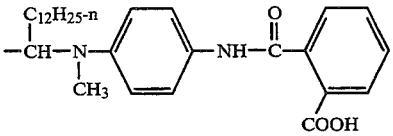
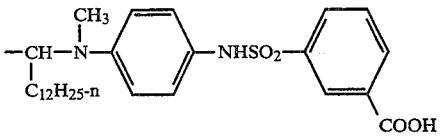
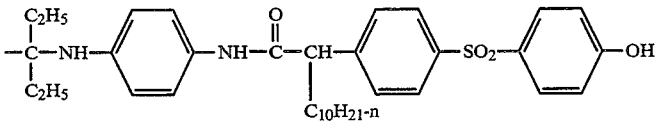
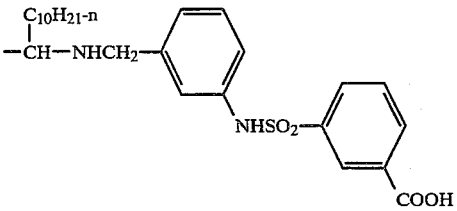

-continued
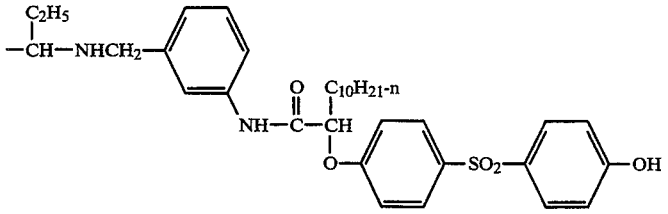
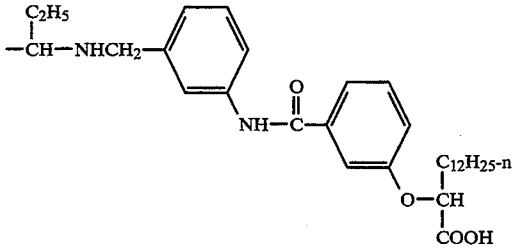
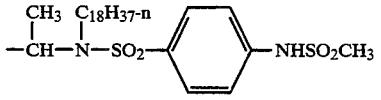
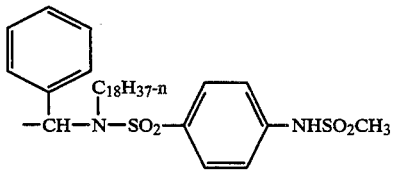
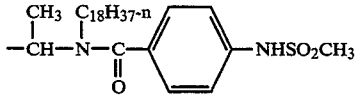
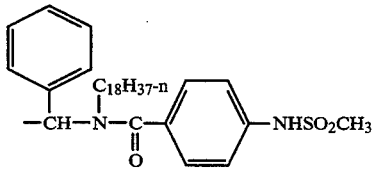
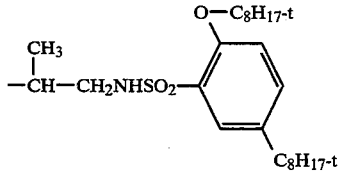
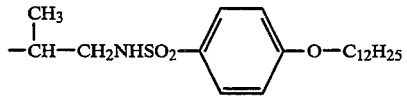
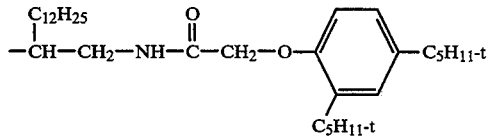

-continued

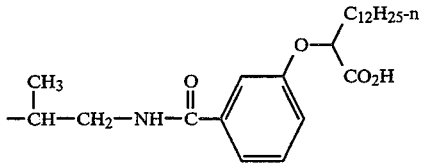

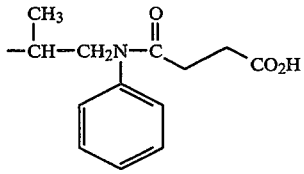

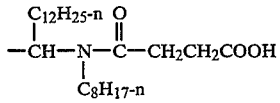

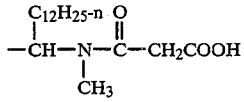

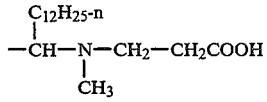

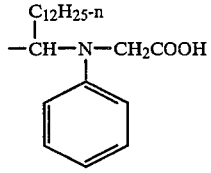

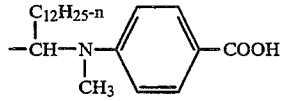

Preferred couplers within the scope of formula I are pyrazolotriazoles, in which X and Y or Y and Z are nitrogen atoms, with the necessary unsaturated bonding being present. Pyrazolotriazole couplers for use according to the instant invention preferably have structures according to formulas II or III:

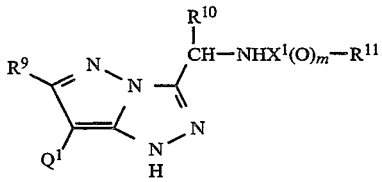

(II)

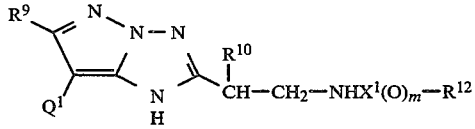

(III)

wherein $R^9$ is a substituent which does not adversely affect the desired properties of the pyrazolotriazole coupler, $R^{10}$ is unsubstituted or substituted alkyl or aryl, $R^{11}$ is unsubstituted or substituted alkyl, aryl or —N-H—$R^{12}$, $R^{12}$ is unsubstituted or substituted alkyl or aryl, $X^1$ is a carbon or sulfur, and m is 1 if X is carbon and 1 or 2 if X is sulfur.

$Q^1$ is a as defined above.

Preferably, $R^9$ is unsubstituted or substituted alkyl or aryl.

$R^{10}$ and $R^{11}$ are preferably independently unsubstituted straight or unsubstituted branched $C_1$–$C_{12}$ alkyls, such as methyl, octyl, t-butyl, decyl, and dodecyl.

It is preferred that at least one of $R^{10}$–$R^{12}$ contain water soluble groups such as carboxy, sulfanamido, $SO_2NH$ amido, hydroxy, sulfo, or ether.

The groups $R^1$ in formula I and $R^9$ in formulas II and III (substituents at the 6-position of the pyrazoloazole ring) should aid solubility or diffusion resistance and produces a dye of desired hue upon reaction of the coupler with an oxidized color developing agent. These groups should not adversely affect the coupler. Exemplary substituent groups include alkyl (including $C_{1-30}$-alkyl, such as methyl, ethyl, propyl, n-butyl, t-butyl, octyl and eicosyl), aryl (including $C_{6-30}$-aryl, for example, phenyl, naphthyl and mesityl), cycloalkyl (such as cyclohexyl and cyclopentyl), alkoxy (including $C_{1-30}$-alkoxy, such as methoxy, i-butoxy and dodecyloxy), aryloxy (including $C_{6-30}$-aryloxy, for example, phenoxy and naphthoxy), alkoxycarbonyl (such as ethoxycarbonyl and dodecyloxycarbonyl), aryloxycarbonyl (such as phenoxycarbonyl), alkylthio (including $C_{1-30}$-alkylthio, such as methylthio and i-butylthio), arylthio (including $C_{6-30}$-arylthio such as phenylthio), alkanesulfonyl (such as ethanesulfonyl and butanesulfonyl), amino, acylamino (including $C_{2-30}$-acylamino, for example acetamido, benzamido and stearamido), ureido, carboxy, cyano, carbamyl (such as methyl carbamyl and hexyl carbamyl), sulfamyl (such as dioctyl sulfamyl and methyloctadecyl sulfamyl), sulfonamido, carboxamido, and heterocyclic groups, such as groups comprised of atoms selected from the group consisting of carbon, oxygen, nitrogen and sulfur atoms necessary to complete a 5- or 6-member heterocyclic ring, for example pyridyl, benzoxazolyl, furyl and thienyl.

The foregoing groups on the pyrazoloazole coupler are unsubstituted or optionally substituted with groups that do not adversely affect the desired properties of the coupler. Examples of useful substituents include ballast groups and coupler moieties known to be useful in the photographic art, and alkyl groups, such as $C_{1-4}$-alkyl, for example, methyl, ethyl and t-butyl.

$R^1$ and $R^9$, defined above, preferably are tertiary carbon groups:

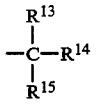

wherein $R^{13}$, $R^{14}$ and $R^{15}$ are individually substituents that do not adversely affect the coupler.

Preferred substituents $R^{13}$, $R^{14}$ and $R^{15}$ include halogen (such as chlorine, bromine and fluorine); alkyl, (including $C_{1-30}$-alkyl, such as methyl, ethyl, propyl, butyl, pentyl, ethylhexyl and eicosyl); aryl (for example $C_{6-30}$-aryl, such as phenyl, naphthyl and mesityl); carbonamido; ureido; carboxy; cyano; sulfamyl; sulfonamido; carboxamido; cycloalkyl (such as cyclohexyl and cyclopentyl); alkoxy (including $C_{1-30}$-alkoxy, such as methoxy, ethoxy, butoxy and dodecyloxy); aryloxy (including $C_{6-30}$-aryloxy, such as phenoxy and naphthoxy); alkylthio (such as $C_{1-30}$-alkylthio, including methylthio, ethylthio, propylthio, butylthio and dodecylthio); arylthio (including $C_{6-30}$-arylthio, such as phenylthio and naphthylthio); amino (including dioctylamino, dimethylamino and dodecylamino); acylamino (such as $C_{1-30}$-acylamino, including acetamido, benzamido and stearamido); and heterocyclyl (including 5- or 6-member heterocyclic rings such as pyrrolyl, oxazolyl and pyridyl).

Optionally, in such a tertiary group, $R^{13}$ can form with one of $R^{14}$ and $R^{15}$ a heterocyclic ring, such as a heterocyclic ring comprised of atoms selected from carbon, oxygen, nitrogen and sulfur atoms necessary to complete a 5- or 6-member heterocyclic ring, for example pyrrole, oxazole, pyridine and thiophene; or $R^{13}$ can form with one of $R^{14}$ and $R^{15}$ a carbocyclic ring, such as cyclohexyl or norbornyl; or $R^{13}$, $R^{14}$ and $R^{15}$ can comprise the carbon and hydrogen atoms necessary to complete a ring, such as an adamantyl ring.

The groups $R^{13}$, $R^{14}$ and $R^{15}$ are unsubstituted or optionally further substituted with groups that do not adversely affect the desired properties of the pyrazolotriazole coupler. The groups can be optionally substituted with groups such as $C_{1-20}$-alkyl, including methyl, ethyl, propyl and butyl; $C_{6-30}$-aryl, such as phenyl and naphthyl; or phenolic, carboxylic acid and heterocyclic substituent groups. Substituents can include ballast groups and coupler moieties known to be useful in the photographic art.

A ballast group, as is known to the art, is an organic radical of such size and configuration as to confer on the coupler molecule sufficient bulk to render the coupler substantially non-diffusible from the layer in which it is coated in a photographic element. Couplers of the invention can contain ballast groups, or be bonded to polymeric chains through one or more of the groups described herein. For example, one or more coupler moieties can be attached to the same ballast group. Representative ballast groups include substituted or unsubstituted alkyl or aryl groups containing 8 to 32 carbon atoms. Representative substituents include alkyl, aryl, alkoxy, aryloxy, alkylthio, arylthio, hydroxy, halogen, alkoxycarbonyl, aryloxycarbonyl, carboxy, acyl, acyloxy, carbonamido, carbamoyl, alkylsulfoxide, arylsulfoxide, alkanesulfonyl, arenesulfonyl, amino, anilino, sulfonamido and sulfamoyl groups where the alkyl and aryl substituents and the alkyl and aryl portions of the alkoxy, aryloxy, alkylthio, arylthio, alkoxycarbonyl, arylcarbonyl, acyl, acyloxy, carbonamido, carbamoyl, alkanesulfonyl, arenesulfonyl, sulfonamido and sulfamoyl substituents contain 1 to 30 carbon atoms and 6 to 30 carbon atoms, respectively, and can be further substituted with such substituents.

Examples of useful tertiary carbon groups for $R^1$ and $R^9$ are:

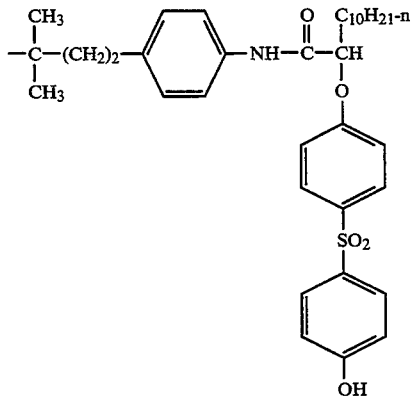

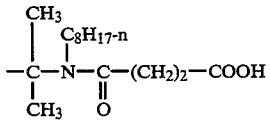

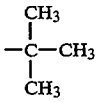

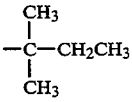

-continued

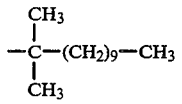

Another specific example of a group useful in the $R^3$ or $R^{21}$ positions defined above is phenoxyethoxy ($—O—CH_2CH_2—O—C_6H_5$).

The pyrazoloazole couplers employed according to the invention contain a coupling-off group. Coupling-off groups, defined by $Q^1$ herein, are well known to those skilled in the art. Representative classes of coupling-off groups include halogen, particularly chlorine, bromine and fluorine, alkoxy, carbonamido, imido, aryloxy including in particular substituted phenoxy, heterocycloxy, sulfonyloxy, acyloxy, heterocyclyl, thiocyano, alkylthio, arylthio, particularly substituted phenylthio, heterocyclylthio, sulfonamido, phosphonyloxy and arylazo. These are described, for example, in U.S. Pat. Nos. 2,355,169, 3,227,551, 3,432,521, 3,476,563, 3,617,291, 3,880,661, 4,052,212, and 4,134,766, and in U.K. Patents and published Applications Nos. 1,466,728, 1,531,927, 1,533,039, 2,006,755A, and 2,017,704A.

Examples of specific coupling-off groups include: —Cl, —F, —SCN, $—OCH_3$, $—OC_6H_5$, $—OCH_2CONHCH_2CH_2OH$, $—OCH_2CONHCH_2CH_2OCH_3$, $—OCH_2CONHCH_2CH_2OCOCH_3$, $—NHSO_2CH_3$, $—OSO_2CH_3$, $—S—(—CH_2—)_2—COOH$,

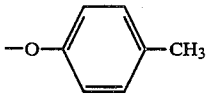

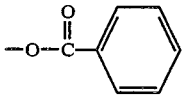

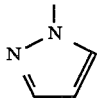

-continued

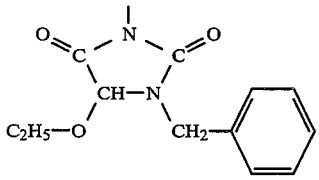

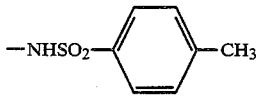

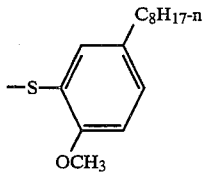

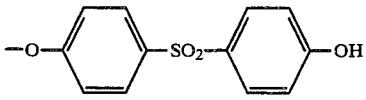

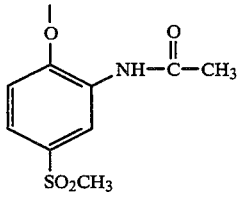

Pyrazoloazole couplers according to the invention are prepared by methods known in the art, such as the general method of synthesis described in *Research Disclosure*, August 1974, Item No. 12443 published by Kenneth Mason Publications, Ltd., The Old Harbourmaster's, 8 North Street, Emsworth, Hampshire P010 7DD, England, and U.S. Pat. No. 4,540,654, and European Patent Nos. EP 0 285 274, EP 0 428 902A1 or EP 0 459 349A1.

Preferred pyrazolotriazole couplers useful according to the invention are given below, without being limited thereto.

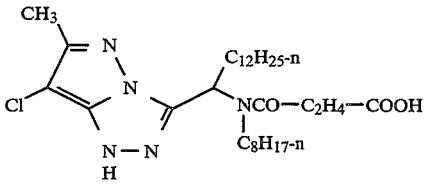

PA-1

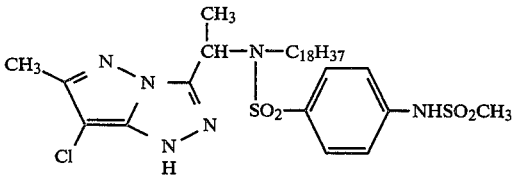

PA-2

-continued
PA-3
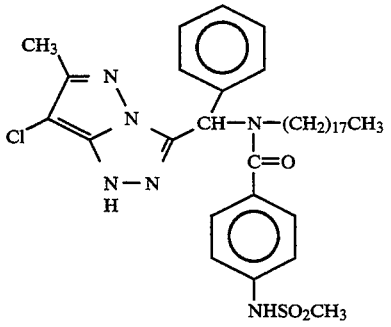
PA-4
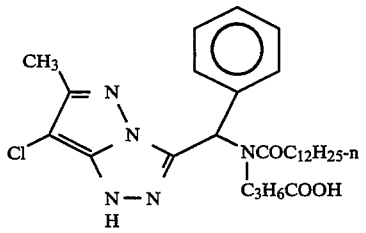
PA-5
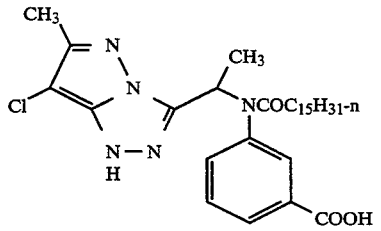
PA-6
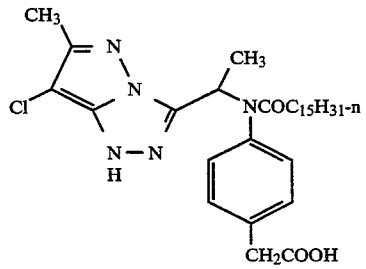
PA-7
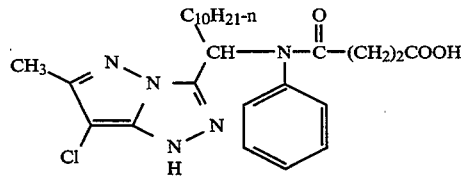
PA-8
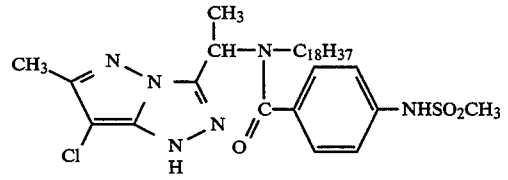

-continued
PA-9
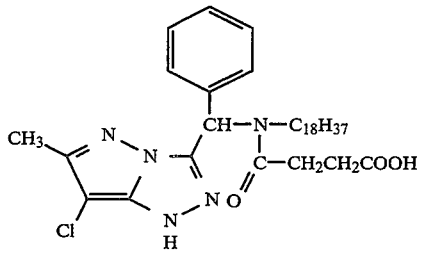
PA-10
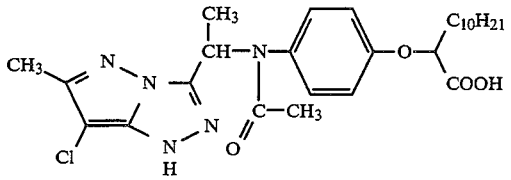
PA-11
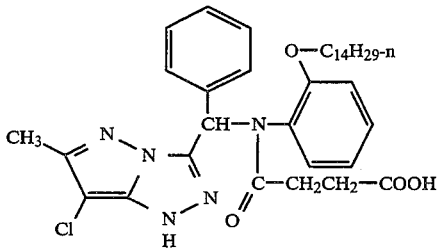
PA-12
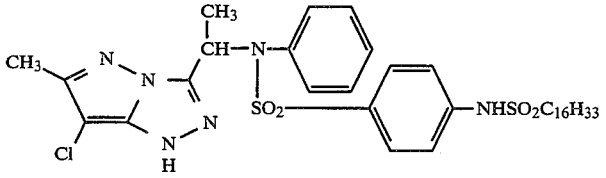
PA-13
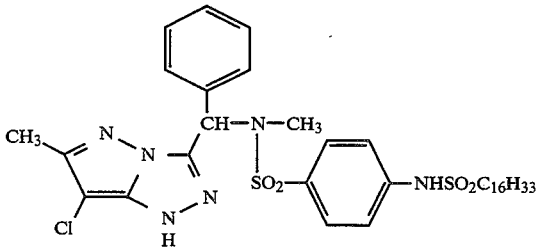
PA-14
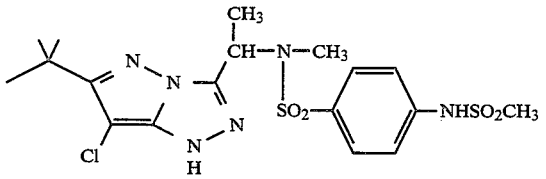
PA-15
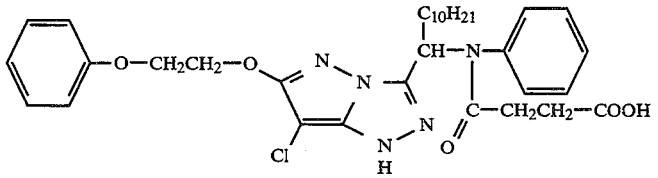

-continued
PA-16
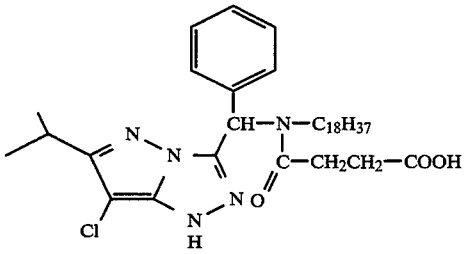
PA-17
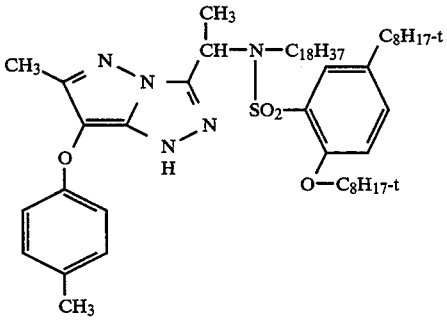
PA-18
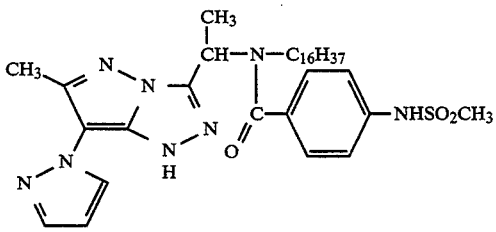
PA-19
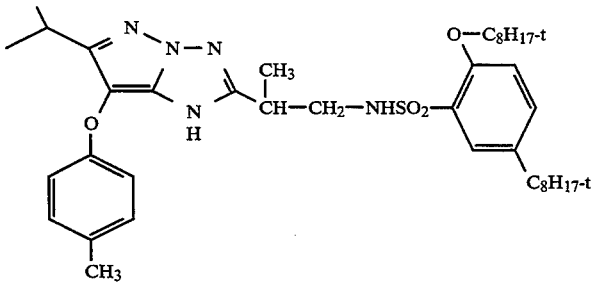
PA-20
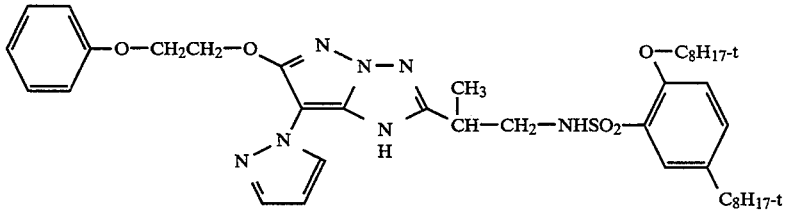
PA-21
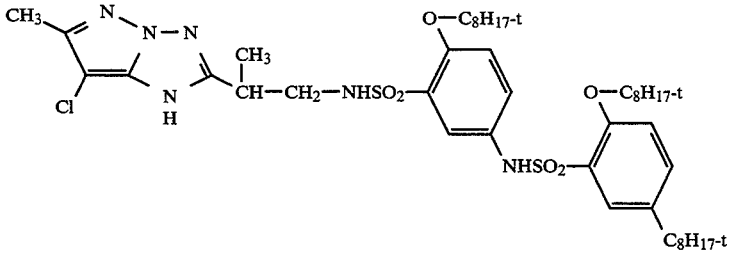

-continued
PA-22
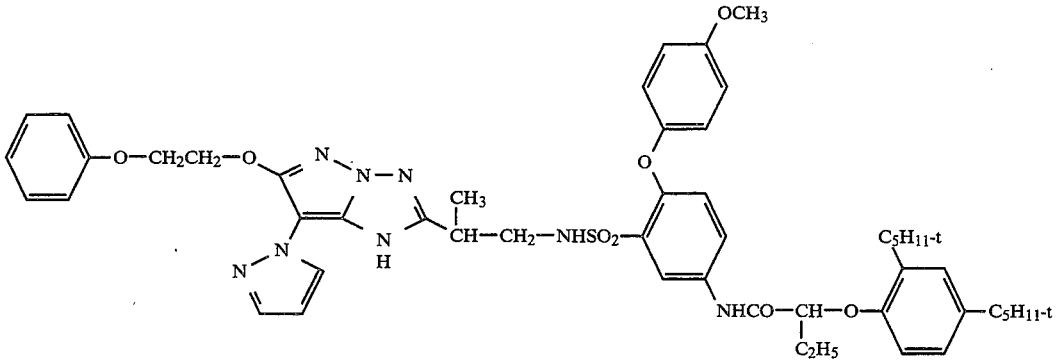
PA-23
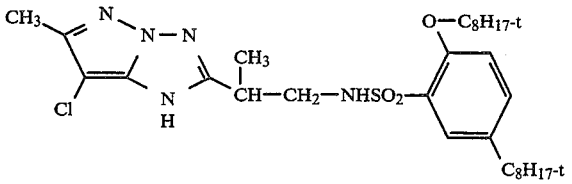
PA-24
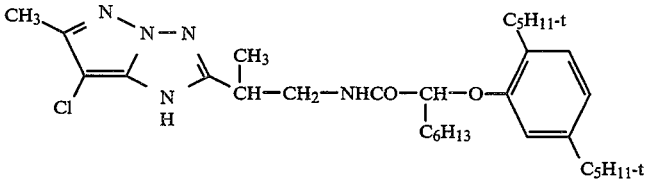
PA-25
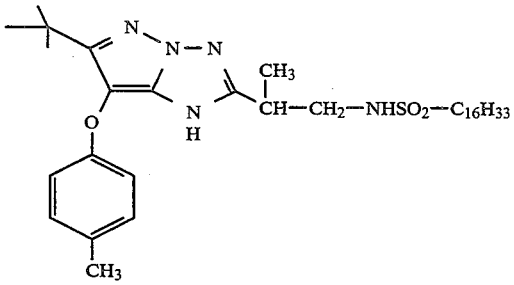
PA-26
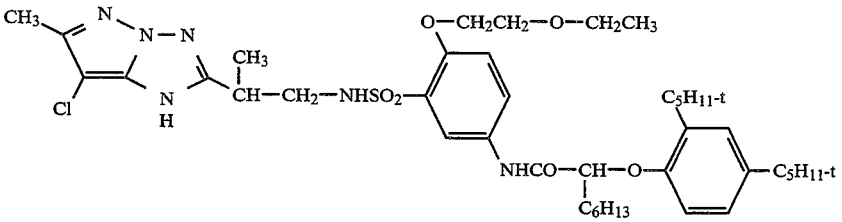
PA-27
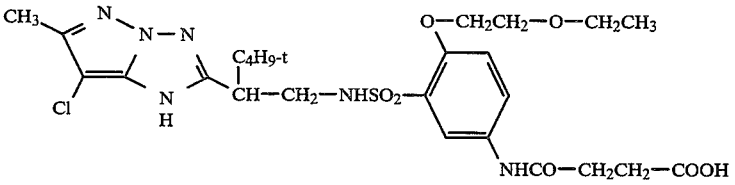

-continued

PA-28

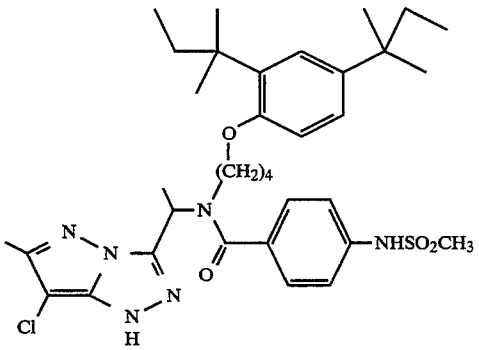

PA-29

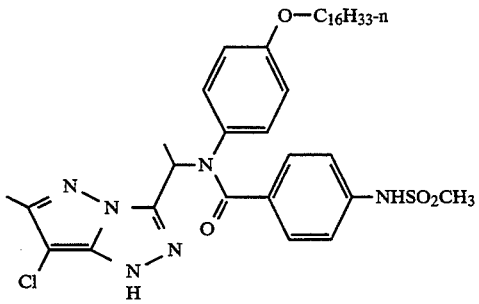

The magenta couplers used in the fast and slower layers as described above can be either coated directly in the layers, or alternatively associated with the appropriate layer. Here, the term "associated" means that the couplers are incorporated in a silver halide layer or incorporated in a photographic element, such that during development the couplers will be able to react with silver halide development products.

The photographic elements in which the couplers and molecules of this invention are employed can be either single- or multi-color elements, the only requirement being that at least two green-sensitive silver halide emulsion layers of different speeds be incorporated into the element. Multi-color elements contain dye image-forming units sensitive to each of the three primary regions of the spectrum. Each unit can comprise a single emulsion layer or multiple emulsion layers sensitive to a given region of the spectrum. The layers of the element, including the layers of the image-forming units, can be arranged in various orders as known in the art.

A typical multi-color photographic element comprises a support bearing a cyan dye image-forming unit comprising at least one red-sensitive silver halide emulsion layer having associated therewith at least one cyan dye-forming coupler, a magenta image forming unit comprising, according to the invention, at least two green-sensitive silver halide emulsion layers each having associated therewith a magenta dye-forming coupler as described above, and a yellow dye image-forming unit comprising at least one blue-sensitive silver halide emulsion layer having associated therewith at least one yellow dye-forming coupler. The element can contain additional layers, such as filter layers, interlayers, overcoat layers, subbing layers, and the like.

In the following discussion of suitable materials for use in the emulsions and elements according to the invention, reference will be made to Research Disclosure, December 1989, Item 308119, published by Kenneth Mason Publications, Ltd., Emsworth, Hampshire P010 7DQ, U.K., the disclosures of which are incorporated herein in their entireties by reference. This publication will be identified hereafter as "Research Disclosure". The elements of the invention can comprise emulsions and additives described in these publications and publications referenced therein.

The silver halide emulsions employed in the elements according to the invention can comprise silver bromide, silver chloride, silver iodide, silver chlorobromide, silver chloroiodide, silver bromoiodide, silver chlorobromoiodide or mixtures thereof. The emulsions can include silver halide grains of any conventional shape or size. Specifically, the emulsions can include coarse, medium, or fine silver halide grains. High aspect ratio tabular grain emulsions are specifically contemplated, such as those disclosed in U.S. Pat. Nos. 4,386,156, 4,399,215, 4,400,463, 4,414,306, 4,414,966, 4,424,310, 4,433,048, 4,434,226, 4,435,501, 4,504,570, 4,672,027, and 4,693,964. Also specifically contemplated are those silver bromoiodide grains with a higher molar proportion of iodide in the core of the grain than in the periphery of the grain, such as those described in U.K. Patent No. 1,027,146; Japanese Patent No. 54/48521; U.S. Pat. Nos. 4,379,837, 4,444,877, 4,565,778, 4,636,461, 4,665,012, 4,668,614, 4,686,178, and 4,728,602; and in European Patent No. 264,954. The silver halide emulsions can be either monodisperse or polydisperse as precipitated. The grain size distribution of the emulsions can be controlled by silver halide grain separation techniques or by blending silver halide emulsions of differing grain sizes.

Sensitizing compounds, such as compounds of copper, thallium, lead, bismuth, cadmium and Group VIII noble metals, can be present during precipitation of the silver halide emulsion.

The emulsions can be surface-sensitive emulsions, that is, emulsions that form latent images primarily on the surfaces of the silver halide grains, or internal latent image-forming emulsions, that is, emulsions that form latent images predominantly in the interior of the silver halide grains. The emulsions can be negative-working emulsions, such as surface-sensitive emulsions or unfogged internal latent image-forming emulsions, or direct-positive emulsions of the unfogged, internal latent image-forming type, which are positive-working when development is conducted with uniform light exposure or in the presence of a nucleating agent.

The silver halide emulsions can be surface sensitized, noble metal (for example, gold), middle chalcogen (such as sulfur, selenium or tellurium), and reduction sensitizers, employed individually or in combination, are specifically contemplated. Typical chemical sensitizers are listed in Research Disclosure, Item 308119, Section III.

The silver halide emulsions can be spectrally sensitized with dyes from a variety of classes, including the polymethine dye class, which includes the cyanines, merocyanines, complex cyanines and merocyanines (such as tri-, tetra- and polynuclear cyanines and merocyanines), oxonols, hemioxonols, styryls, merostyryls and streptocyanines. Illustrative spectral sensitizing dyes are described in Research Disclosure, Item 308119, Section IV and the publications cited therein.

Suitable vehicles for the emulsion layers and other layers of the elements according to the invention are described in Research Disclosure, Item 308119, Section IX and the publications cited therein.

The photographic elements according to the invention can include additional couplers such as those described in Research Disclosure Section VII, paragraphs D–G and the publications cited therein. These additional couplers can be incorporated as described in Research Disclosure Section VII, paragraph C and the publications cited therein. The elements according to the invention can contain colored masking couplers such as described in U.S. Pat. No. 4,883,746, with image modifying couplers such as described in U.S. Pat. Nos. 3,148,062, 3,227,554, 3,733,201, 4,409,323, and 4,248,962 and with couplers that release bleach accelerators such as described in European Patent Application No. 193,389.

A photographic element according to the invention, or individual layers thereof, can also include any of a number of other well-known additives and layers. These include, for example, optical brighteners (see Research Disclosure Section V), antifoggants and image stabilizers (see Research Disclosure Section VI), light-absorbing materials such as filter layers of intergrain absorbers, and light-scattering materials (see Research Disclosure Section VIII), gelatin hardeners (see Research Disclosure Section X), oxidized developer scavengers, coating aids and various surfactants, overcoat layers, interlayers, barrier layers and antihalation layers (see Research Disclosure Section VII, paragraph K), antistatic agents (see Research Disclosure Section XIII), plasticizers and lubricants (see Research Disclosure Section XII), matting agents (see Research Disclosure Section XVI), antistain agents and image dye stabilizers (see Research Disclosure Section VII, paragraphs I and J), development-inhibitor releasing couplers and bleach accelerator-releasing couplers (see Research Disclosure Section VII, paragraph F), development modifiers (see Research Disclosure Section XXI), and other additives and layers known in the art.

The photographic elements according to the invention can be coated on a variety of supports as described in Research Disclosure Section XVII and the references cited therein. These supports include polymeric films, such as cellulose esters (for example, cellulose triacetate and diacetate) and polyesters of dibasic aromatic carboxylic acids with divalent alcohols (such as polyethylene terephthalate), paper, and polymer-coated paper.

Photographic elements according to the invention can be exposed to actinic radiation, typically in the visible region of the spectrum, to form a latent image as described in Research Disclosure Section XVIII, and then processed to form a visible dye image as described in Research Disclosure Section XIX. Processing to form a visible dye image includes the step of contacting the element with a color developing agent to reduce developable silver halide and oxidize the color developing agent. The oxidized color developing agent in turn reacts with the coupler to yield a dye.

Preferred color developing agents are p-phenylene diamines. Especially preferred are 4-amino-3-methyl-N,N-diethylaniline hydrochloride, 4-amino-3-methyl-N-ethyl-N-$\beta$-(methanesulfonamido)-ethylaniline sulfatehydrate, 4-amino-3-methyl-N-ethyl-N-$\beta$-hydroxyethylaniline sulfate, 4-amino-3-$\beta$-(methanesulfonamido)ethyl-N,N-diethylaniline hydrochloride and 4-amino-N-ethyl-N-(2-methoxyethyl)-m-toluidine-di-p-toluenesulfonic acid.

With negative-working silver halide, the process step described above leads to a negative image. The described elements are preferably processed in the known C-41 color process as described in, for example, the British Journal of Photography Annual of 1988, pages 196–98. To obtain a positive (or reversal) image, the color development step can be preceded by development with a nonchromogenic developing agent to develop exposed silver halide but not form dye, and then uniformly fogging the element to render unexposed silver halide developable, followed by development with a chromogenic developer. Alternatively, a direct-positive emulsion can be employed to obtain a positive image.

Development is followed by the conventional steps of bleaching, fixing, or bleach-fixing, to remove silver and silver halide, washing and drying. Bleaching and fixing can be performed with any of the materials known to be used for that purpose. Bleach baths generally comprise an aqueous solution of an oxidizing agent such as water soluble salts and complexes of iron (III) (such as potassium ferricyanide, ferric chloride, ammonium or potassium salts of ferric ethylenediaminetetraacetic acid), water-soluble dichromates (such as potassium, sodium, and lithium dichromate), and the like. Fixing baths generally comprise an aqueous solution of compounds that form soluble salts with silver ions, such as sodium thiosulfate, ammonium thiosulfate, potassium thiocyanate, sodium thiocyanate, thioureas, and the like.

The invention is further illustrated by the following examples, without being limited thereby.

EXAMPLE 1: DETERMINATION OF RELATIVE COUPLER ACTIVITY BY CZA

Single layer photographic elements are prepared by coating a cellulose acetate-butyrate film support with a photosensitive layer containing a silver bromide emulsion at 0.45 g/m2, gelatin at 3.78 g/m$^2$ and an image coupler (1.6 mmol/m$^2$) dispersed in an indicated weight of coupler solvent.

The photosensitive layer is overcoated with a layer containing gelatin at 2.69 g/m$^2$ and bis-vinylsulfonyl-methyl ether hardner at 1.75 wt % based on the total weight of the gelatin.

Samples of each element are exposed imagewise through a graduated density test object and processed at 100° F. according to the following process, wither with or without the use of citrazinic acid (CZA). The following sequence of processing solutions is employed: development, 3 min 15 sec; low pH stop bath (3% acetic acid), 2 min; bleach, 4 min; wash, 1 min; fix, 4 min; wash, 4 min; dry. The developer, bleach and fix solutions are described in Tables I–III below.

TABLE I

| Developer solution | |
|---|---|
| Anhydrous potassium carbonate | 37.50 g |
| Anhydrous sodium sulfite | 4.25 g |
| Potassium iodide | 0.02 g |
| Sodium bromide | 1.30 g |
| Hydroxylamine sulfate | 2.00 g |
| 4-Amino-3-methyl-N-ethyl-N-β'-hydroxyethylaniline sulfate | 3.55 g |
| Citrazinic acid (CZA) (optional) | 4.00 g |
| Water to make 1 liter, pH 10.0 | |

TABLE II

| Bleach solution | |
|---|---|
| Ammonium bromide | 150.00 g |
| Ammonium ferric EDTA (1.56 M) | 175.00 ml |
| Acetic acid | 9.50 ml |
| Sodium nitrate | 35.00 g |
| Water to make 1 liter, pH 6.00 | |

TABLE III

| Fix solution | |
|---|---|
| Ammonium thiosulfate (58%) | 214.00 g |
| (Ethylenedinitrilo)tetraacetic acid, disodium salt | 1.29 g |
| Sodium metabisulfite | 11.00 g |
| Sodium hydroxide (50%) | 4.70 g |

TABLE III-continued

| Fix solution |
|---|
| Water to make 1 liter, pH 6.50 |

Densitometry provides a measure of gamma, defined as the maximum slope between any two adjacent density points, for the processes with and without CZA. The ratio [Gamma (+CZA)/Gamma(−CZA)]×100 provides a measure of the activity of the coupler toward Dox in the presence of a Dox competitor. A higher ratio indicates that the coupler is more able to react with Dox compared to CZA, and thus is expected to display higher activity in a highly competitive multilayer film environment.

The foregoing procedure was used to determine the relative rates of a number of magenta couplers as shown in Table IV below.

TABLE IV

| Pyrazoloazoles | | |
|---|---|---|
| Compound | Ratio, Compound:Solvent | Relative Rate |
| PA-1 | 1:0.5 A | 50.6 |
| PA-2 | 1:0.5 A | 56.3 |
| PA-3 | 1:0.5 A | 37.0 |
| PA-4 | 1:0.5 A | 56.9 |
| PA-5 | 1:0.5 A | 68.8 |
| PA-6 | 1:0.5 A | 84.1 |

A = Phosphoric acid tri(methylphenyl) ester

EXAMPLE 2: EXPERIMENTAL

The multilayer color photographic elements were prepared in two formats. The first format includes a magenta record having three layers, slow, mid and fast. Examples 1 to 3 were prepared in this format. The second format includes a magenta record having two layers, slow and fast. Examples 4 and 5 were prepared in this format. In the examples, the following components were used:

Cyan dye-forming coupler

C-1

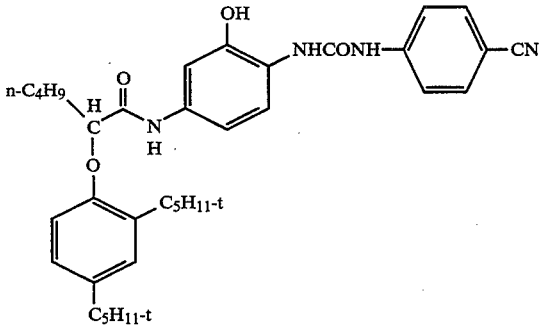

Magenta dye-forming couplers

PA-1

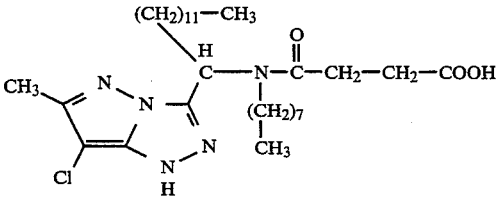

-continued
PA-2
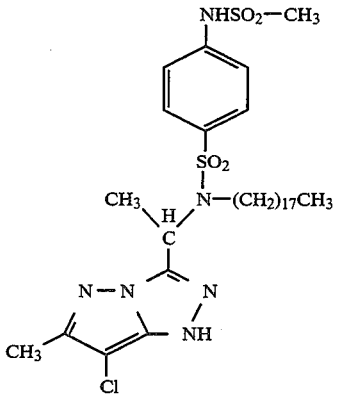
PA-3
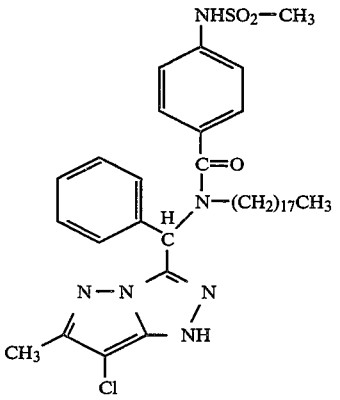
Yellow dye-forming coupler
Y-1
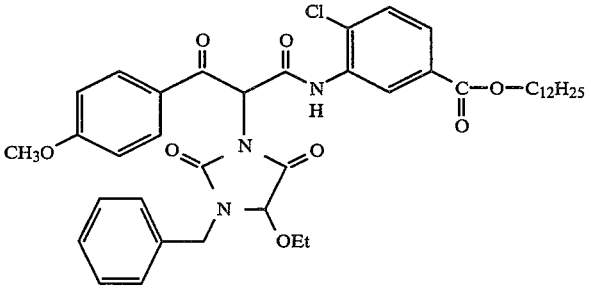
DIR couplers
DIR-1
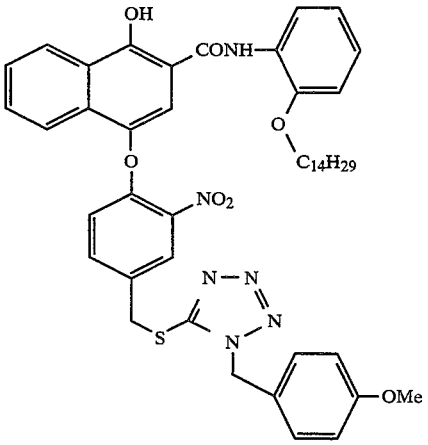

-continued
DIR-2
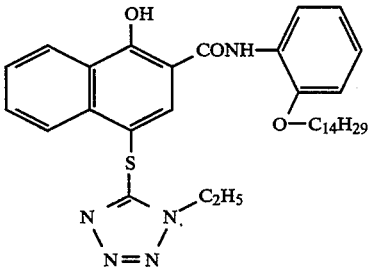
DIR-3
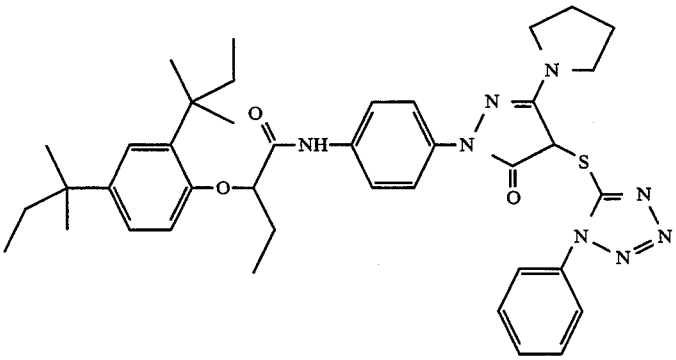
DIR-4
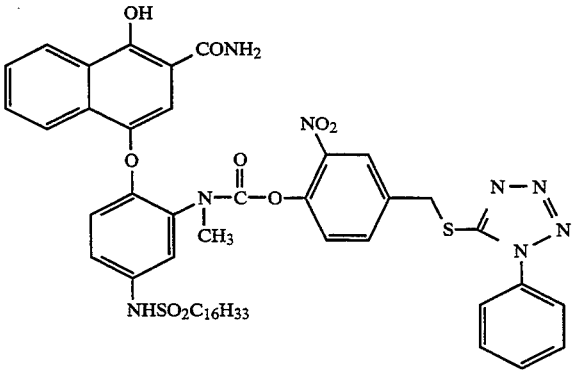
DIR-5
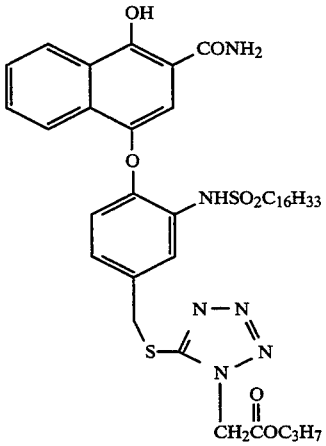

-continued
DIR-6
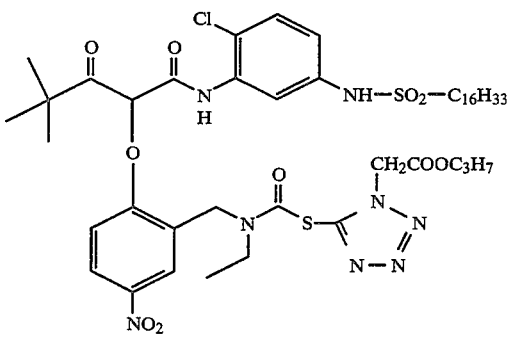
Bleach accelerator releasing coupler
B-1
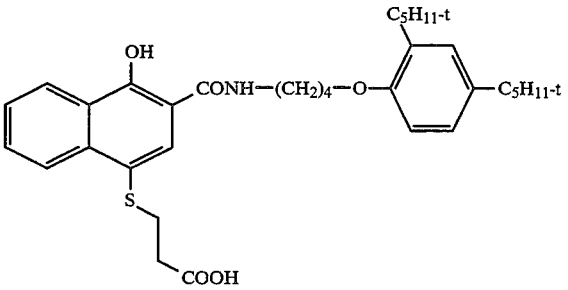
Oxidized developer scavenger
S-1
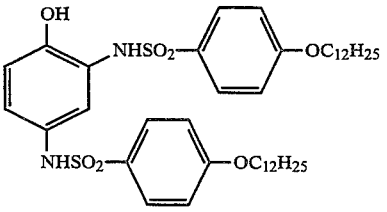
Masking coupler
MC-1
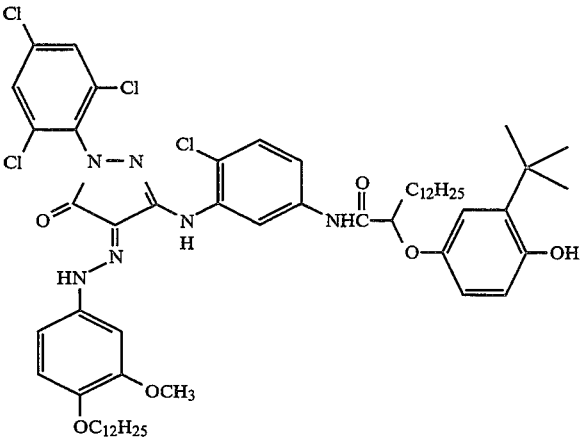
UV Dyes
UV-1
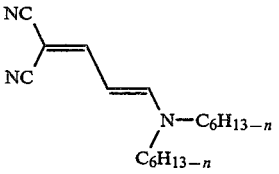

-continued

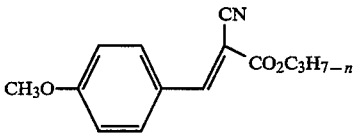

UV-2

COMPARATIVE EXAMPLE 1

A photographic element was produced by coating the following layers on a cellulose triacetate film support (coverages are in grams per meter squared):

Layer 1 (antihalation layer): black colloidal silver sol containing silver at 0.323 g/m$^2$ and gelatin at 2.691 g/m$^2$.

Layer 2 (slow cyan layer): a blend of two red-sensitized silver iodobromide grains: (i) a medium sized tabular emulsion (3.0 mole % iodide) at 1.3 g/m$^2$, and (ii) a smaller cubic emulsion (3.5 mole % iodide) at 1.1 g/m$^2$; gelatin at 3.0 g/m$^2$; cyan dye-forming coupler C-1 at 0.87 g/m$^2$; DIR coupler DIR-1 at 0.065 g/m$^2$; bleach accelerator releasing coupler B-1 at 0.01 g/m$^2$; and antifoggant 4-hydroxy-6-methyl-1,3,3a,7-tetraazaindene at 0.036 g/m$^2$.

Layer 3 (fast cyan layer): a red-sensitized tabular silver iodobromide emulsion (6.0 mole % iodide) at 0.81 g/m$^2$; cyan dye-forming coupler C-1 at 0.151 g/m$^2$; DIR couplers DIR-1 at 0.065 g/m$^2$ and DIR-2 at 0.032 g/m$^2$; gelatin at 1.68 g/m$^2$; and antifoggant 4-hydroxy-6-methyl-1,3,3a,7-tetraazaindene at 0.036 g/m$^2$.

Layer 4 (interlayer): oxidized developer scavenger S-1 at 0.054 g/m$^2$ and gelatin at 1.3 g/m$^2$.

Layer 5 (slow magenta layer): a blend of two green-sensitized tabular silver iodobromide emulsions: (i) 3.0 mole % iodide at 0.48 g/m$^2$, and (ii) 1.5 mole % iodide at 0.47 g/m$^2$; magenta dye-forming coupler PA-1 at 0.21 g/m$^2$; DIR coupler DIR-3 at 0.054 g/m$^2$; masking coupler MC-1 at 0.065 g/m$^2$; gelatin at 1.29 g/m$^2$; and antifoggant 4-hydroxy-6-methyl-1,3,3a,7-tetraazaindene at 0.036 g/m$^2$.

Layer 6 (mid magenta layer): a green-sensitized tabular silver iodobromide emulsion (3.0 mole % iodide) at 0.646 g/m$^2$; magenta dye-forming coupler PA-1 at 0.102 g/m$^2$; DIR couplers DIR-4 at 0.0269 g/m$^2$ and DIR-5 at 0.0032 g/m$^2$; masking coupler MC-1 at 0.043 g/m$^2$; gelatin at 1.23 g/m$^2$; and antifoggant 4-hydroxy-6-methyl-13,3a,7-tetraazaindene at 0.036 g/m$^2$.

Layer 7 (fast magenta layer): a green-sensitized tabular silver iodobromide emulsion (3.0 mole % iodide) at 0.754 g/m$^2$; magenta dye-forming image coupler PA-1 at 0.129 g/m$^2$; masking coupler MC-1 at 0.054 g/m$^2$; DIR coupler DIR-3 at 0.0377 g/m$^2$; gelatin at 1.40 g/m$^2$; and antifoggant 4-hydroxy-6-methyl-1,3,3a,7-tetraazaindene at 0.036 g/m$^2$.

Layer 8 (yellow filter layer): gelatin at 0.86 g/m$^2$, Carey Lea silver at 0.043 g/m$^2$, and oxidized developer scavenger S-1 at 0.054 g/m$^2$.

Layer 9 (slow yellow layer): a blue-sensitized tabular silver iodobromide emulsion (3.0 mole % iodide) at 0.36 g/m$^2$; a blue-sensitized tabular silver bromoiodide emulsion (3.0 mole % iodide) at 0.10 g/m$^2$; yellow dye-forming coupler Y-1 at 0.883 g/m$^2$; DIR coupler DIR-6 at 0.097 g/m$^2$; and gelatin at 1.73 g/m$^2$.

Layer 10 (fast yellow layer): a blue-sensitized tabular silver iodobromide emulsion (3.0 mole % iodide) at 0.43 g/m$^2$; yellow dye-forming coupler Y-1 at 0.513 g/m$^2$; DIR coupler DIR-6 at 0.032 g/m$^2$; and gelatin at 0.807 g/m$^2$.

Layer 11 (protective overcoat and UV filter layer): gelatin at 1.24 g/m$^2$; silver bromide Lippmann emulsion at 0.23 g/m$^2$; UV-1 and UV-2 (1:1 ratio) absorbers at a total of 0.23 g/m$^2$; and bis(vinylsulfonyl)methane added at 1.8% of total gelatin weight.

COMPARATIVE EXAMPLE 2

A second photographic element, designated Example 2, was prepared in a similar manner to Example 1. The following modifications were made:

The magenta dye-forming coupler PA-1 was replaced with a pyrazolotriazole coupler PA-2 in Layer 7 (fast magenta layer), Layer 6 (mid magenta layer), and Layer 5 (slow magenta layer). The DIR coupler DIR-3 was used at 0.027 g/m$^2$ in Layer 7 of Example 2.

Examples 1 and 2 are not within the scope of the present invention because couplers having structures according to formulas I and II are not coated in silver halide layers of different speeds.

EXAMPLE 3 (INVENTION)

A third photographic element, designated Example 3, was prepared in a similar manner to Example 2. The following modifications were made:

The magenta dye-forming coupler PA-2 in Layer 5 was replaced with pyrazolotriazole coupler PA-3 at 0.388 g/m$^2$. The magenta dye-forming coupler PA-2 in Layer 6 was replaced with pyrazolotriazole coupler PA-3 at 0.183 g/m$^2$.

COMPARATIVE EXAMPLE 4

A fourth photographic element, designated Example 4, was prepared in a similar manner to Example 1. The following modifications were made:

The magenta dye-forming coupler PA-1 in Layer 7 was used at 0.188 g/m$^2$. Also, a blend of two green-sensitized tabular silver iodobromide grains was used: (i) a fast emulsion (3.0 mole % iodide) at 0.754 g/m$^2$, and (ii) a medium speed emulsion (3.0 mole % iodide) at 0.538 g/m$^2$. The DIR coupler DIR-3 was used at 0.0377 g/m$^2$. Layer 6 was deleted. The DIR coupler DIR-3 in Layer 5 was used at 0.007 g/m$^2$, and the magenta dye-forming coupler PA-1 was used at 0.350 g/m$^2$.

EXAMPLE 5 (INVENTION)

A fifth photographic element, designated Example 5, was prepared in a similar manner to Example 4. The following modifications were made:

The pyrazolotriazole magenta dye-forming coupler PA-2 in Layer 7 was used at 0.129 g/m$^2$ to replace PA-1. The pyrazolotriazole magenta dye-forming coupler PA-3 in Layer 5 was used at 0.498 g/m$^2$ in place of magenta dye-forming coupler PA-1. The DIR coupler DIR-3 was used at 0.0065 g/m$^2$.

The photographic data of the films is shown in Table 1 below.

As used in the table, "relative green granularity" pertains to the observed change in $\sigma_D$. $\sigma_D$ is rms (root mean square) granularity. See James, Page 619). Each 5% change in $\sigma_D$ of the green record represents one granularity unit (GU). The "−2" relative green granularity denotes the "two-underexposure" granularity.

N refers to "normal" midscale neutral exposure at 0.82 log E exposure units over ISO-speed of film unit.

$G_n$ is gamma of a neutral exposure. $G_g$ is gamma of a green layer only exposure. Relative green speed is relative to Example 1. C refers to a comparative example.

TABLE V

| EXAMPLE | MAGENTA COUPLER FM/MM/SM | RELATIVE GREEN SPEED Gn | Photographic Data GAMMA Gg | GAMMA Gn | Gg/Gn | RELATIVE GREEN GRANULARITY '−2' (GU) | RELATIVE GREEN GRANULARITY 'N' (GU) |
|---|---|---|---|---|---|---|---|
| 1(c) | PA-1/PA-1/PA-1 | 1. | 1.075 | 0.546 | 1.969 | 0 | 0 |
| 2(c) | PA-2/PA-2/PA-2 | 1.00 | 0.805 | 0.592 | 1.360 | −3 | −4 |
| 3 | PA-2/PA-3/PA-3 | 1.01 | 1.052 | 0.582 | 1.808 | −3 | −4 |

As can be seen from Table V, the green speeds of the three elements are about the same, but the elements with PA-2 in the fast magenta (FM) layer have lower granularity. Between elements with PA-2 in the fast magenta layer, the element with PA-3 in mid and slow magenta layers (Example 3) has the higher onto green interlayer interimage effect relative to the example including only PA-2 (Example 2), as indicated by the higher gamma ratio of Example 3.

The data in Table VI show that the granularity advantage of the PA-2/PA-3 coating (Example 5) over PA-1/PA-1 is maintained in this double-coated structure.

TABLE VI

| EXAMPLE | MAGENTA COUPLER FM/SM | GREEN SPEED Gn | Photographic Data GAMMA Gn | RELATIVE GREEN GRANULARITY '-2' (GU) | RELATIVE GREEN GRANULARITY 'N' (Gu) |
|---|---|---|---|---|---|
| 4(c) | PA-1/PA-1 | 295 | 0.588 | 0 | 0 |
| 5 | PA-2/PA-3 | 295 | 0.590 | −4 | −4 |

It is to be understood that the foregoing detailed description and specific examples, while indicating preferred embodiments of the present invention, are given by way of illustration and not limitation. Many changes and modifications within the scope of the present invention may be made without departing from the spirit thereof, and the invention includes all such modifications.

What is claimed is:

1. A photographic element comprising a support and at least two green-sensitive silver halide emulsion layers of different sensitivity which are not separated by an imaging silver halide emulsion layer sensitive to red or blue light, each green-sensitive emulsion layer comprising a two-equivalent pyrazoloazole magenta dye-forming coupler having a structure according to formula I

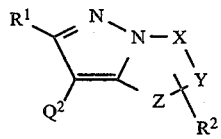

(I)

wherein $R^1$ is a substituent in the 6-position which does not adversely affect the desired properties of the coupler, $Q^2$ is a coupling-off group, X, Y, Z are individually carbon or nitrogen atoms necessary to complete an azole ring, with unsaturated bonding being present in the ring as needed, $R^2$ denotes the group

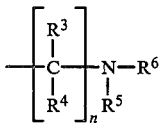

$R^3$, $R^4$ are individually hydrogen or unsubstituted or substituted alkyl or aryl, at most one of $R^3$ and $R^4$ being hydrogen, n is 1 or 2, $R^5$, $R^6$ are individually hydrogen, unsubstituted or substituted alkyl or aryl, —C(O)—$R^7$ or —$SO_2R^7$, at most one of $R^5$ and $R^6$ being hydrogen, $R^7$ is unsubstituted or substituted alkyl or aryl or —NH—$R^8$, and $R^8$ is unsubstituted or substituted alkyl or aryl, wherein the activity of said dye-forming coupler present in the layer of lower sensitivity is less than the activity of said dye-forming coupler present in the layer of higher sensitivity, and wherein the layer of lower sensitivity has the lowest sensitivity of any green-sensitive layer containing a magenta dye-forming coupler present in the element.

2. A photographic element as claimed in claim 1, wherein the activity of said dye-forming coupler present in said layer of lower sensitivity is less than about 85% of the activity of said dye-forming coupler present in said layer of higher sensitivity.

3. A photographic element as claimed in claim 1, wherein $R^1$ is an unsubstituted or substituted alkyl, aryl, alkoxy or carbonamido group.

4. A photographic element as claimed in claim 1, wherein $R^l$ is an unsubstituted or substituted alkyl or aryl group.

5. A photographic element as claimed in claim 1, wherein X, Y and Z are individually carbon or nitrogen atoms necessary to complete a triazole ring.

6. A photographic element as claimed in claim 5, wherein said pyrazoloazole couplers are pyrazolotriazoles having a structure according to formula II

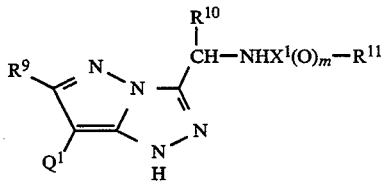

(II)

or formula III

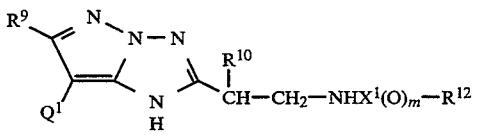

(III)

wherein $R^9$ is a substituent which does not adversely affect the desired properties of the pyrazolotriazole coupler, $R^{10}$ is unsubstituted or substituted alkyl or aryl, $R^{11}$ is unsubstituted or substituted alkyl, aryl, or —N-H—$R^{12}$, $R^{12}$ is unsubstituted or substituted alkyl or aryl, $Q^1$ is a coupling-off group, X is a carbon or sulfur, and m is 1 or 2.

7. A photographic element as claimed in claim 6, wherein $R^9$ is an unsubstituted or substituted alkyl or aryl group.

8. A photographic element as claimed in claim 1, wherein said magenta dye-forming couplers are selected from the group consisting of:

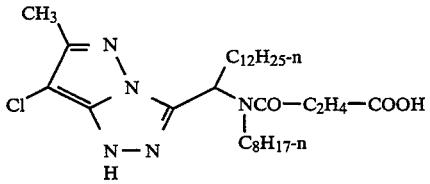

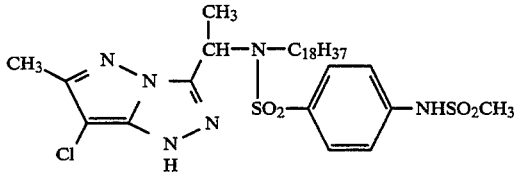

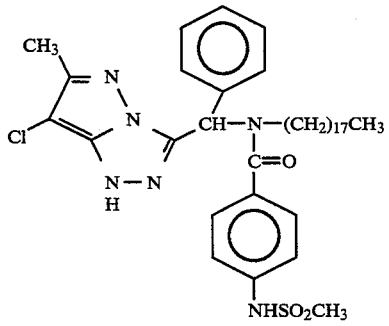

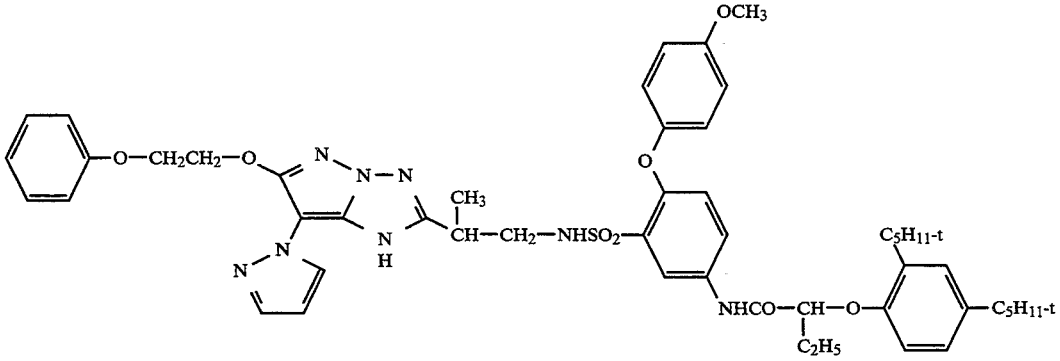

-continued

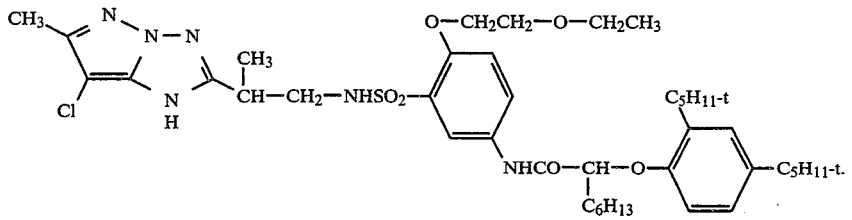

9. A photographic element according to claim 1, wherein the coupler of higher activity has the structure:

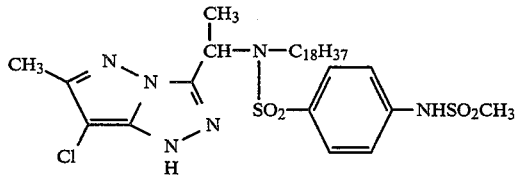

and the coupler of lower activity has the structure:

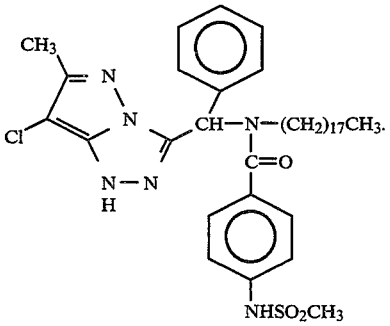

10. A photographic element as claimed in claim 1, wherein $R^1$ is a tertiary carbon group having the structure

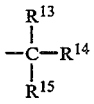

wherein $R^{13}$, $R^{14}$ and $R^{15}$ are individually substituents that do not adversely affect said coupler.

11. A photographic element as claimed in claim 10, wherein $R^{13}$, $R^{14}$ and $R^{15}$ are individually halogen atoms or unsubstituted or substituted alkyl, aryl, carbonamido, ureido, carboxy, cyano, sulfamyl, sulfonamido, carboxamido, cycloalkyl, alkoxy, alkylthio, aryloxy, arylthio, amino, acylamino or heterocyclyl groups.

12. A photographic element as claimed in claim 10, wherein $R^{13}$ form with one of $R^{14}$ and $R^{15}$ a heterocyclic ring.

13. A photographic element as claimed in claim 10, wherein $R^{13}$ forms with at least one of $R^{14}$ and $R^{15}$ a carbocyclic ring.

14. A photographic element according to claim 1 comprising a third silver halide emulsion layer sensitized to green light having a sensitivity intermediate between that of the layer of higher sensitivity and that of lower sensitivity, wherein said third layer comprises the same magenta dye-forming coupler as the layer of lower sensitivity.

15. A multicolor photographic element comprising a support bearing (a) a cyan dye image-forming unit comprising at least one red-sensitive silver halide emulsion layer having associated therewith at least one cyan dye-forming coupler, (b) a magenta dye image-forming unit comprising at least first and second green-sensitive silver halide emulsions of different sensitivities, each having associated therewith at least one two-equivalent magenta dye-forming coupler, wherein the first and second green-sensitive emulsions are not separated by an imaging silver halide emulsion layer sensitive to red or blue light, and (c) a yellow dye image-forming unit comprising at least one blue-sensitive silver halide emulsion layer having associated therewith at least one yellow dye-forming coupler, wherein each of said magenta couplers has a structure according to formula I

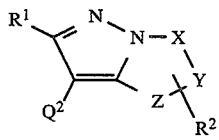

(I)

wherein $R^1$ is a substituent in the 6-position which does not adversely affect the desired properties of the coupler, $Q^2$ is a coupling-off group, X, Y, Z are individually carbon or nitrogen atoms necessary to complete an azole ring, with unsaturated bonding being present in the ring as needed, $R^2$ denotes the group

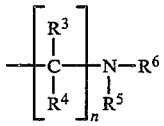

$R^3$, $R^4$ are individually hydrogen or unsubstituted or substituted alkyl or aryl at most one of $R^3$ and $R^4$ being hydrogen, n is 1 or 2, $R^5$, $R^6$ are individually hydrogen, unsubstituted or substituted alkyl or aryl, —C(O)—$R^7$ or —$SO_2R^7$, at most one of $R^5$ and $R^6$ being hydrogen, $R^7$ is unsubstituted or substituted alkyl or aryl or —N-H—$R^8$, and $R^8$ is unsubstituted or substituted alkyl or aryl, wherein the activity of said magenta dye-forming coupler present in the layer of lower sensitivity is less than the activity of said magenta dye-forming coupler present in the layer of higher sensitivity, and wherein the layer of lower sensitivity has the lowest sensitivity of any green-sensitive layer containing a magenta dye-forming coupler present in the element.

16. A process for developing an image in a photographic element as claimed in claim 1, comprising the step of developing said element with a silver halide color developing agent.

17. A photographic element according to claim 1, wherein said layer of lower sensitivity is adjacent to said layer of higher sensitivity.

18. A photographic element according to claim 1, wherein the activity of said magenta dye-forming coupler present in the layer of lower sensitivity, is lower than or equal to the activity of any of the magenta dye-forming couplers present in any green-sensitive layers of the element.

19. A photographic element according to claim 15, comprising a third silver halide emulsion layer sensitized to green light having a sensitivity intermediate between that of the layer of higher sensitivity and that of lower sensitivity, wherein said third layer comprises the same magenta dye-forming coupler as the layer of lower sensitivity.

20. A photographic element according to claim 1, wherein $Q^2$ is not photographically active.

* * * * *